US005607152A

United States Patent [19]

Strassburger

[11] Patent Number: 5,607,152

[45] Date of Patent: Mar. 4, 1997

[54] PLURALITY OF BASEBALLS EACH HAVING DIFFERENT COLORED INDICIA FOR TRAINING BASEBALL BATTERS AND A METHOD FOR USE

[76] Inventor: John Strassburger, 10952 Big Bone Rd., Union, Ky. 41091

[21] Appl. No.: 550,456

[22] Filed: Oct. 30, 1995

[51] Int. Cl.[6] ..... A63B 69/00

[52] U.S. Cl. ..... 473/451

[58] Field of Search ..... 273/25, 26 R, 273/60 R, 60 A; 40/327; 434/247

[56] References Cited

U.S. PATENT DOCUMENTS

| | | | |
|---|---|---|---|
| 1,108,441 | 8/1914 | Hubbell | 473/52 |
| 2,925,273 | 2/1960 | Pratt | 273/26 |
| 3,152,803 | 10/1964 | Sain, Jr. | 273/26 |
| 4,867,450 | 9/1989 | Katz | 273/26 R X |
| 4,867,452 | 9/1989 | Finley | 273/65 E |
| 4,991,838 | 2/1991 | Groves | 273/26 R |

OTHER PUBLICATIONS

Worth Sports Co Advertisement Jan. 1976 1 page.

*Primary Examiner*—William H. Grieb

*Attorney, Agent, or Firm*—Wood, Herron & Evans, P.L.L.

[57] ABSTRACT

A baseball batter training kit is provided which includes a plurality of baseballs each having different colored indicia on the baseball. A baseball batter is required to recognize and identify the color of the indicia after the baseball is pitched, causing the batter to focus on the ball as it is delivered by the pitcher toward the hitting zone.

3 Claims, 1 Drawing Sheet

PLURALITY OF BASEBALLS EACH HAVING DIFFERENT COLORED INDICIA FOR TRAINING BASEBALL BATTERS AND A METHOD FOR USE

BACKGROUND OF THE INVENTION

The game of baseball requires several skills, one of which is hitting the ball. Baseball players spend numerous hours in batting practice to improve their skills at hitting the ball. Customarily, batting practice consists of a coach, a pitcher, or an automatic pitching machine repetitively pitching balls to a batter.

Hitting the baseball requires several important skills. One of these skills is for batters to keep their eyes focused on the ball as the ball approaches the plate. This helps the batter make contact with the ball when he swings the bat while the ball is in the hitting zone. Unfortunately, it is difficult for coaches to determine if batters are keeping their eyes on the ball as it travels toward the hitting zone.

Several devices and methods have been invented to aid pitchers in improving their skills. U.S. Pat. Nos. 2,925,273 issued to Pratt, 3,152,803 issued to Sain, and 4,991,838 issued to Groves all disclose training aids directed towards improving a pitchers ability to throw a variety of different pitches. For example, Sain U.S. Pat. No. 3,152,803 discloses a baseball having a continuous spiraling line on its surface that appears as a dot when the pitcher throws a curve ball or slider. The Sain patent teaches that the size of the dot enables the pitcher to determine the effectiveness of a curve ball or slider.

However, none of the prior art training aids are directed towards improving the ability of baseball batters to keep their eyes focused on the ball as the ball travels towards the hitting zone. There is a distinct need for a training aid to improve the skills of baseball batters.

SUMMARY OF THE INVENTION

Accordingly, it is an object of the present invention to provide a method for improving the ability of batters to focus their eyesight on the ball. It is also an object of the present invention to provide a training kit designed specifically for training baseball batters to keep their eyes focused on the ball as it travels toward the hitting zone.

The objects and advantages of the present invention are obtained by providing a method of training a baseball batter comprising pitching a series of baseballs having different colored indicia to a baseball batter and requiring the batter to recognize and identify the color of the indicia on the baseball. The objects and advantages of the invention are also achieved by providing a training kit comprising a plurality of baseballs, each having a different colored indicia on the outside surface of the baseball. The indicia can be either in the form of colored laces or colored markings on the outside surface of the ball.

In addition to the foregoing, further objects and advantages of the present invention will become apparent to persons skilled in the art upon review of the following detailed description taken in conjunction with the drawings.

DETAILED DESCRIPTION

The present invention is a method of training baseball batters comprising pitching to a batter a series of baseballs each having different colored indicia and requiring the batter to recognize and identify the color of the indicia on the baseball.

The present invention uses a plurality of baseballs 11. Each baseball 11 has an outside surface 12 and laces 13 that hold the outside surface 12 on the baseball 11. The laces 13 are colored, providing indicia for the batter to view. The color of the laces will vary from ball to ball and can be any color including red, orange, yellow, blue, violet, green, black, or white.

According to the present invention a batting coach, pitcher, or automatic pitching machine selects a baseball 11. The baseball is pitched to a baseball batter. The batter is required to recognize the color of the laces 13 on the baseball 11. The batter then must call out the color of the laces 13 on the baseball 11 at the same time he swings at the baseball 11. This is then repeated with a baseball that has different colored laces or indicia.

By requiring the batter to recognize and identify the color of the laces 13 on the thrown baseball 11, the batter is forced to concentrate and focus his eyes on the moving baseball. This method of training a baseball batter will enable the baseball coach to determine if the batter is properly focusing the batter's eyes on the pitched baseball 11 as it moves toward the hitting zone. If the batter cannot identify the color of the laces, he is probably not keeping his eye on the ball and the coach can instruct him to do so. This will train the batter to keep his eye on the ball. Similarly, baseball fielders can also be asked to identify the color of the indicia, thereby forcing the fielders to focus on the baseball.

Figure 1:
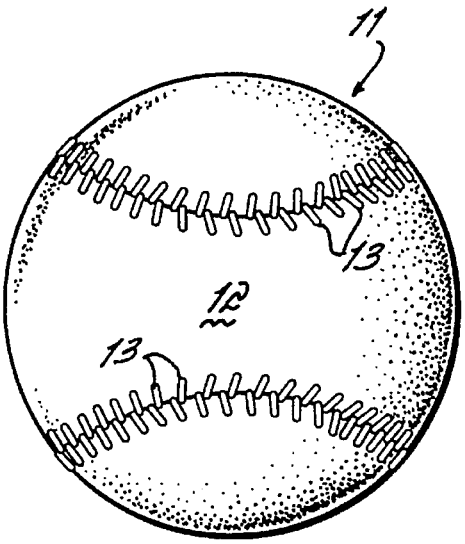
FIG. 1 is a front view of a baseball for use in the present invention.
Figure 2:
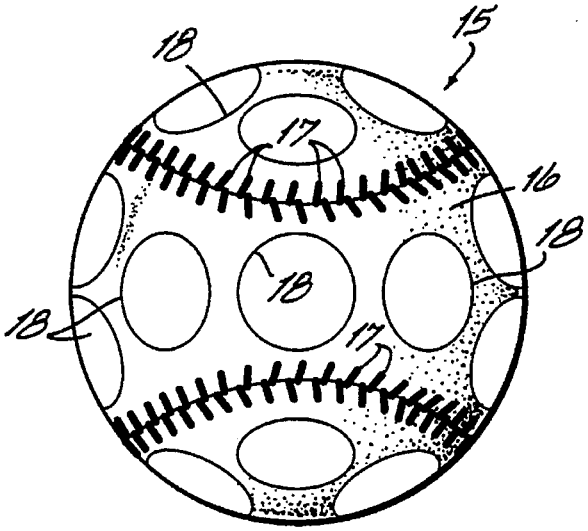
FIG. 2 is a front view of an alternate embodiment for use in the present invention.

FIG. 2 shows an alternative embodiment of a baseball 15 for use in the present invention. The baseball 15 has an outside surface 16 and laces 17. The baseball 15 has indicia 18 on the outside surface 16. The indicia 18 can be placed on the outside surface 16 of the baseball 15 by virtually any method. The indicia 18 may be printed, painted, inked, dyed, or adhesively fixed to the outside surface 16 of the baseball 15. This figure is merely exemplary, however, and the indicia 18 can be in virtually any form. For example, the indicia 18 can be a stripe around the entire circumference, or a dot, circle, or other geometric shape placed on the outside surface 16 of the baseball The indicia 18 can also consist of having either a portion of or the entire the outside surface 16 of the baseball 15 colored a certain color. On different balls the indicia will preferably be different colors such as red, orange, yellow, blue, green, violet, black or white.

Figure 3:
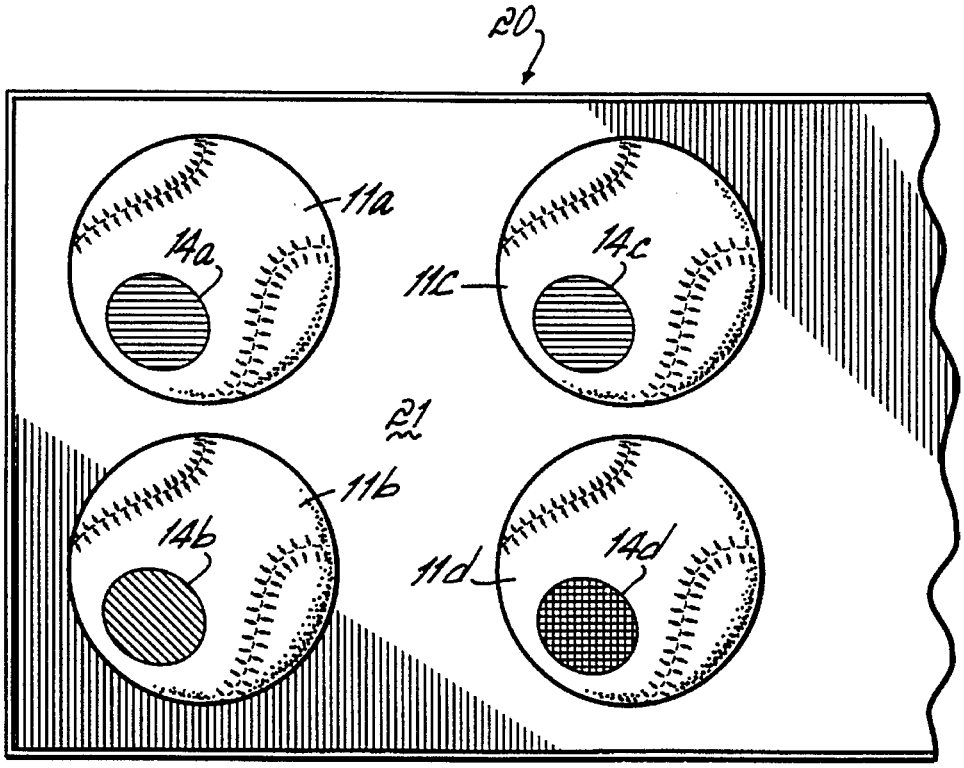
FIG. 3 is a top view of a baseball batter training kit.

The present invention also includes a training kit for training baseball batters to focus their eyes on the baseball as it moves towards the plate. The kit is simply a plurality of baseballs packaged together where the balls are marked with two or more different, identifiable indicia, as previously described. FIG. 3 shows a baseball training kit 20 comprising a container 21 holding a plurality of baseballs 11, each having a different colored indicia 14 on the ball. The container 21 can be virtually any receptacle suitable for holding a plurality of baseballs 11. The container 21 can be a box, a bucket, a basket, a sack, a bag, or a tray. It will be appreciated that the training kit 20 includes at least two baseballs 11. Preferably, the training kit 20 will include more than two baseballs 11, with each of the baseballs 11 having a different colored indicia 14.

For example, the training kit 20 can comprise four baseballs 11*a*–11*d*. Baseball 11*a* can have indicia 14*a* consisting of a blue dot. Baseball 11*b* can have indicia 14*b* consisting of a green dot placed on the outside cover of the ball. Baseball 11*c* has indicia 14*c* in the form of a red dot on a portion of the outside cover of the ball. Baseball 11*d* has indicia 14*d* in the form of a black dot placed on the outside surface of the baseball. It will be appreciated that FIG. 3 is illustrative only, and virtually any number of baseballs 11 having different colored and styled indicia 14 can be included in a training kit 20.

It will be appreciated by persons skilled in the art that various modifications can be made to the structures shown and described herein without departing from the spirit and scope of the present invention. Different indicia, colors, numbers of balls and combinations of balls in the training kit are all within the scope of this invention. The scope of the invention, however, is limited only by the scope of the claims appended hereto.

What is claimed is:

1. A method of training a baseball batter, the method comprising pitching a series of baseballs one at a time to said batter, each of said baseballs having an outside surface having a different colored indicia, and wherein said batter calls out the color of said indicia to indicate that the batter is keeping his eye focused on the baseball.

2. The method of claim 1, wherein said different colored indicia is a colored mark on said outside surface of said baseball.

3. The method of claim 1, wherein said different colored indicia is colored laces.

* * * * *